US005294900A

United States Patent [19]

Mohabbatizadeh et al.

[11] Patent Number: 5,294,900

[45] Date of Patent: Mar. 15, 1994

[54] SWITCH ASSEMBLY

[75] Inventors: Akbar Mohabbatizadeh; Ali Malekzadeh, both of Huntington Beach, Calif.

[73] Assignee: Eaton Corporation, Cleveland, Ohio

[21] Appl. No.: 951,669

[22] Filed: Sep. 25, 1992

[51] Int. Cl.[5] ..... H01H 83/00

[52] U.S. Cl. ..... 335/20; 335/78; 341/31

[58] Field of Search ..... 341/31; 250/229-231; 335/131, 132, 78-86, 128, 14, 20

[56] References Cited

U.S. PATENT DOCUMENTS

| | | |
|---|---|---|
| 1,993,115 | 3/1935 | Reeves . |
| 3,182,158 | 5/1965 | Beardow et al. . |
| 3,274,354 | 9/1966 | Stevens . |
| 3,315,535 | 4/1967 | Stevens . |
| 3,488,611 | 1/1970 | Harper . |
| 3,906,222 | 9/1975 | Astler et al. . |
| 4,096,368 | 6/1978 | Grebner . |
| 4,305,054 | 12/1981 | Woodard . |
| 4,357,511 | 11/1982 | Tenner et al. . |
| 4,359,618 | 11/1982 | Stevens . |
| 4,496,813 | 1/1985 | Fukushima . |
| 4,520,334 | 5/1985 | Stearley et al. . |
| 5,047,628 | 10/1991 | Schmidt et al. . |

*Primary Examiner*—Lincoln Donovan
*Attorney, Agent, or Firm*—Tarolli, Sundheim & Covell

[57] ABSTRACT

A switch assembly has an actuator assembly which is operable to actuate switches between first and second conditions. A pushbutton is movable from an initial position through an intermediate position to a fully actuated position to affect operation of the actuator assembly to actuate the switches from the first condition to the second condition. As the pushbutton moves to the fully actuated position, a holding coil is energized to hold the actuator assembly in the actuated condition to maintain the switches in the second condition upon a releasing of the pushbutton. A control circuit is activated by optical sensors to prevent energization of the holding coil until the pushbutton has been moved from the initial position to the fully actuated position. The control circuit maintains the holding coil energized until the pushbutton has been released for movement back to its initial position and then operated for a second time to its fully actuated position. Therefore, partial actuation or teasing of the pushbutton does not cause the holding coil to become energized or de-energized. A remote switch is actuatable to effect de-energization of the holding coil.

30 Claims, 2 Drawing Sheets

SWITCH ASSEMBLY

BACKGROUND OF THE INVENTION

The present invention relates to a switch assembly for use in electrical circuitry.

Switch assemblies are commonly used in aircraft to control electrical circuitry. An operator of the aircraft may inadvertently tease, i.e., partially actuate, the switch assembly without intending to have the switch assembly initiate a control function. Thus, the operator may repeatedly depress a pushbutton for a switch assembly through a short distance toward a fully actuated position without intending to actuate the switch assembly and initiate a control function. Once the operator has manually depressed the pushbutton to the fully actuated position with the intent to initiate a control function, he may again inadvertently tease the switch assembly by only partially releasing the switch assembly and repeatedly moving it back to its fully actuated position. Since the operator intends for the switch assembly to initiate a control function only when the switch assembly is fully actuated, it is important that the inadvertent teasing of the switch assembly by the operator does not result in the initiation of a control function.

When a switch assembly is in an actuated condition, it may be advantageous to be able to change the switch status from the actuated condition to an unactuated condition from a remote location. Thus, when a switch has been actuated to an on condition, it may be desirable to change the switch status to the off condition from a remote location. This will enable an operator remotely to remove the power from a holding coil and be certain that the switch assembly is in the off condition.

SUMMARY OF THE INVENTION

An improved switch assembly includes switch contacts which are at least partially disposed in a switch housing and are operable between first and second conditions by an actuator assembly. A manually actuatable member is movable relative to the switch housing to effect operation of the actuator assembly between unactuated and actuated conditions. A holding coil is energizeable to maintain the actuator assembly and the switches in their actuated conditions. A control assembly is effective to control energization of the holding coil in response to movement of the manually actuatable member.

A remote switch may advantageously be connected with the control assembly. The remote switch is actuatable to effect de-energization of the holding coil and operation of the actuator assembly to an unactuated condition. In addition, operating the remote switch is effective to prevent subsequent energization of the holding coil.

The switch assembly does not respond to teasing, i.e., partial actuation. Thus, the control assembly is ineffective to either energize or de-energize the holding coil in response to movement of the manually actuatable member through less than a full operating stroke.

In one embodiment of the invention, the control assembly includes optical sensors which cooperate with shutters to control the output from the control assembly. The shutters move with the manually actuatable member and are effective to cause a change in the condition of the optical sensors upon movement of the manually actuatable member. The shutters change the condition of the optical sensors in a manner which effects energization or de-energization of the holding coil only in response to movement of the manually actuatable member through a complete operating stroke.

BRIEF DESCRIPTION OF THE DRAWINGS

The foregoing and other objects and features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
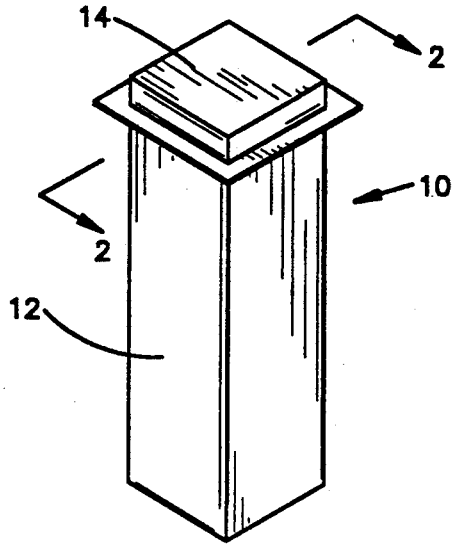
FIG. 1 is a pictorial illustration of a switch assembly constructed in accordance with the present invention.

A switch assembly 10 (FIG. 1) includes a rectangular housing 12 and a manually actuatable pushbutton 14. The switch assembly 10 is of the alternate action type. Thus, initially depressing the pushbutton 14 through its operating stroke actuates switches 16 (FIG. 3) disposed in the housing 12 from a first condition to a second condition. When the pushbutton 14 is released, the switches 16 remain in the second condition. When the pushbutton 14 is again depressed through its operating stroke and released, the switches 16 change from the second condition back to the first condition.

Figure 3:
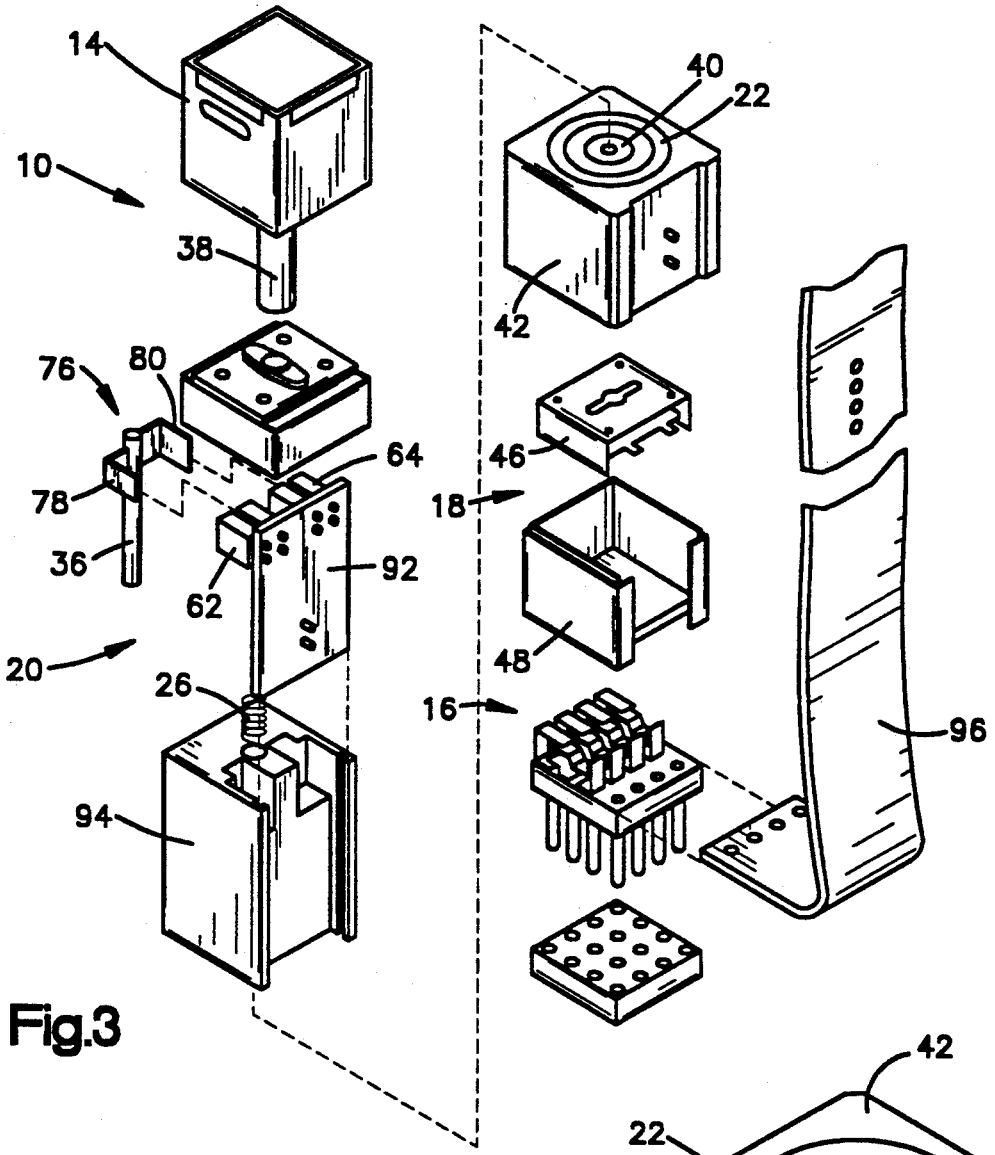
FIG. 3 is a simplified and exploded pictorial illustration of the components of the switch assembly of FIG. 1.
Figure 4:
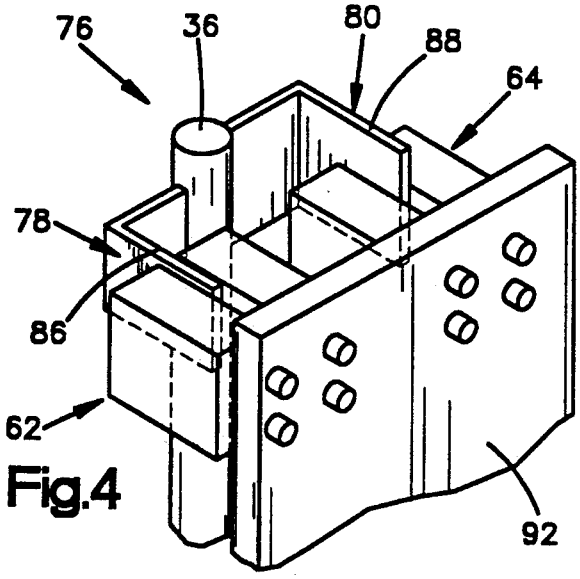
FIG. 4 is an enlarged fragmentary pictorial view illustrating the relationship between a pair of optical sensors and a pair of shutters in the switch assembly of FIG. 1.

Depressing the pushbutton 14 through its entire operating stroke from the initial or release position to a fully actuated position operates an actuator assembly 18 (FIG. 3). Operation of the actuator assembly 18 actuates the switches 16 from the first condition to the second condition with a snap action which occurs as the pushbutton 14 reaches its fully actuated position. Actuation of the switches 16 closes their normally open contacts and opens their normally closed contacts.

Figure 6:
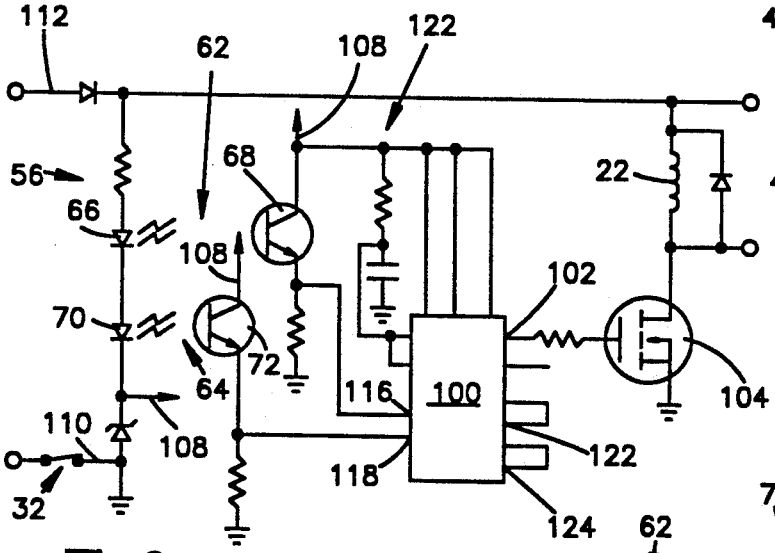
FIG. 6 is a schematic illustration of a control circuit provided in the switch assembly of FIG. 1.

In addition, depressing the pushbutton 14 through its entire operating stroke from the initial position to the fully actuated position effects operation of a control assembly 20 (FIG. 3) to energize a holding coil indicated schematically at 22 in FIGS. 3 and 6. Energization of the holding coil 22 maintains the actuator assembly 18 (FIG. 3) in its actuated condition. Maintaining the actuator assembly 18 in its actuated condition holds the switches 16 in their second or actuated condition. The switches 16 are connected with suitable control circuitry (not shown) and, upon being operated from their first or unactuated condition to their second or actuated condition, initiate suitable control functions.

When the pushbutton 14 is manually released after having been pressed to its fully actuated condition, a return spring 26 (FIG. 3) moves the pushbutton through its entire operating stroke back to its initial position. At this time, the holding coil 22 is effective to maintain the actuator assembly 18 in the actuated condition. Therefore, the switches 16 remain in their second or actuated condition.

When the switches 16 are to be returned to their first or unactuated condition, the pushbutton 14 is against depressed through its entire operating stroke to a fully actuated position. This results in the control assembly 20 being actuated to de-energize the holding coil 22. Although the holding coil 22 is immediately de-energized upon movement of the pushbutton 14 to its fully actuated position, the pushbutton itself holds the actuator assembly 18 in the actuated condition. Therefore, the switches 16 remain in their second or actuated condition while the pushbutton 14 is manually held in its fully actuated position.

When the pushbutton 14 is manually released, the return spring 26 moves the pushbutton back to its initial position. As the pushbutton 14 is retracted, the actuator assembly 18 is released. The spring actuated switches 16 snap back to their first or unactuated condition as the pushbutton 14 returns to its initial position.

In accordance with one of the features of the present invention, partially actuating (teasing) the pushbutton 14 is ineffective to either actuate the switches 16 or effect energization or de-energization of the holding coil 22. If an operator inadvertently fiddles with the pushbutton 14 and repeatedly partially depresses the pushbutton, nothing happens until the pushbutton moves through its entire operating stroke to its fully actuated position. The actuator assembly 18 is ineffective to operate the switches 16 until the pushbutton 14 reaches the fully actuated position at the end of its operating stroke. Also, the control assembly 20 is ineffective to energize the holding coil 22 until the pushbutton 14 reaches the fully actuated position at the end of its operating stroke.

Similarly, repeated partial releasing and depressing of the pushbutton 14 after it has been moved to its fully actuated position is ineffective to release the switches 16 or de-energize the holding coil 22. The actuator assembly 18 holds the switches 16 in the second or actuated condition as the pushbutton 14 returns to its initial position. The control assembly 20 maintains the coil 22 energized until the pushbutton has returned to its initial position and has been depressed to its fully actuate position for a second time.

When the pushbutton 14 is moved from its initial position to its fully actuated position with the holding coil 22 energized and the switches 16 actuated, the holding coil is immediately de-energized upon movement of the pushbutton 14 to its fully actuated position. However, the actuator assembly 18 is effective to hold the switches 16 in their second or actuated condition until the pushbutton 14 moves back to its initial position. As the pushbutton 14 moves back to its initial position at the outer end of its operating stroke, the switches 16 are operated back to their first condition with a snap action. Therefore, if the pushbutton is inadvertently moved back and forth through a portion of an operating stroke without being released for movement to its initial position, the switches 16 remain actuated and the holding coil 22 remains energized.

In accordance with another feature of the invention, actuation of a remote switch 32 (FIG. 6) from its normal closed position will cause the control assembly 20 (FIG. 3) to de-energize the holding coil 22. If the remote switch 32 is positioned to its open condition when the holding coil 22 is energized and the switches 16 have been closed, the control assembly effects de-energization of the holding coil 22 and the actuator assembly 18 releases the switches 16 for operation to their first or unactuated condition. If the remote switch 32 opened, subsequent depressing of the pushbutton 14 does not result in energization of the holding coil 22.

The switches 16 are operated to their actuated or second condition by the actuator assembly 18 when the pushbutton 14 is depressed to its fully actuated position with the remote switch 32 closed. Thus, opening the remote switch 32 changes the switch assembly 10 from an alternate action switch assembly to a momentary action switch assembly in which the switches 16 are actuated while the pushbutton 14 is manually held in its fully actuated position. During operation of the switch assembly 10 as a momentary action switch assembly with the remote switch 32 open, the switches 16 are operated from the first or unactuated condition to the actuated or second condition with a snap action by the actuator assembly 18 as the pushbutton 14 reaches its fully actuated position. Similarly, the switches 16 operate back to their first or unactuated condition with a snap action as the pushbutton 14 moves back to its initial position.

Actuator Assembly

The actuator assembly 18 transfers force from the pushbutton 14 to the switches 16 to effect actuation of the switches from their first condition to their second condition upon movement of the pushbutton 14 to its fully actuated position with the holding coil 22 de-energized. The actuator assembly 18 releases the switches 16 for actuation from their second condition to their first condition upon movement of the pushbutton 14 to its initial position with the holding coil 22 de-energized.

Figure 2:
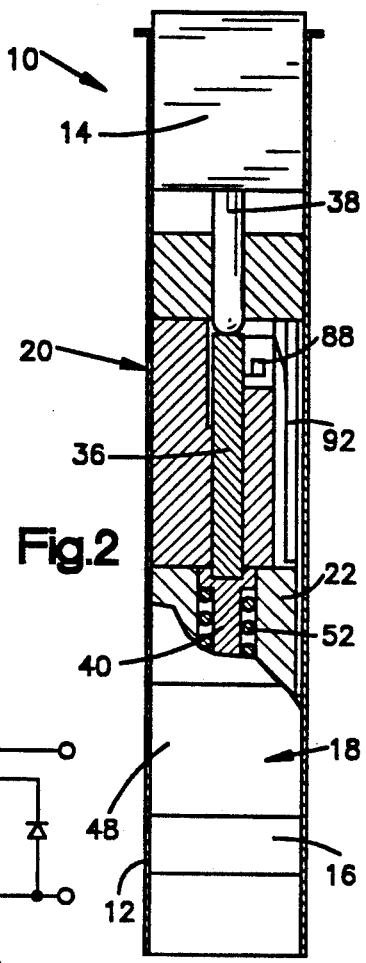
FIG. 2 is a simplified sectional view, taken generally along the line 2—2 of FIG. 1, further illustrating the construction of the switch assembly.
Figure 5:
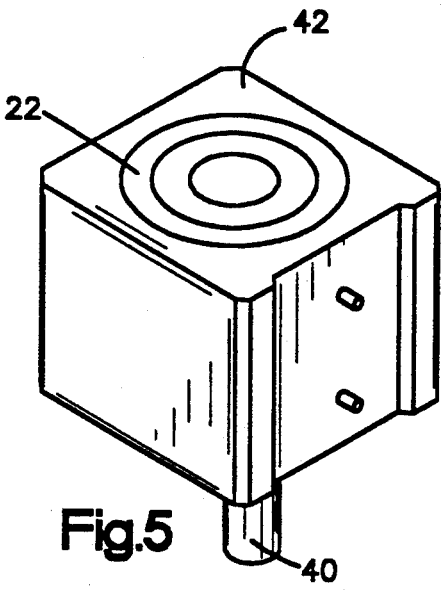
FIG. 5 is a simplified pictorial illustration of the manner in which an actuator rod is held in an extended position by a holding coil in the switch assembly of FIG. 1.

The actuator assembly 18 includes a control rod or shutter carrier 36 in the control assembly 20. The rod 36 transmits force from a plunger 38 connected with the pushbutton 14 to a magnetic actuator rod 40 (FIGS. 2, 3 and 5). The magnetic actuator rod 40 is slidably received in a block 42 containing the holding coil 22. The holding coil 22 extends around the actuator rod 40.

The actuator rod 40 extends downwardly through a guide member 46 (FIG. 3) into engagement with a force transmitting member 48 in the actuator assembly 18. A flat lower side surface of the force transmitting member 48 is pressed against the switches 16 by force transmitted from the plunger 38 of the pushbutton 14 through the shutter carrier rod 36 and actuator rod 40. The force applied against the switches 16 by the flat lower side surface on the force transmitting member 48 causes the switches to be actuated with a snap action as the pushbutton 14 is depressed to its fully actuated position.

The pushbutton 14, rod 36, actuator rod 40 and actuator member 48 all move downwardly during the initial portion of an operating stroke of the pushbutton 14 without causing actuation of the switches 16. As the pushbutton 14 reaches its end of stroke position, the final increment of movement of the force transmitting member 48 causes the switches 16 to operate with a snap action. This results in the switches 16 being operated from their first or unactuated condition to their second or actuated condition as the pushbutton 14 reaches its end of stroke position. The switches 16 may have any one of many different known constructions, such as disclosed in U.S. Pat. Nos. 3,315,535 or 4,496,813.

When the pushbutton 14 is at its end of stroke position and the actuator rod 40 has been extended (FIG. 5) against the influence of a biasing spring 52 (FIG. 2), the control assembly 20 energizes the holding coil 22 to hold the actuator rod 40 in its extended condition. This maintains the actuator assembly 18 in an actuated condition when the pushbutton 14 is released for movement back to its initial position. Therefore, the switches 16 are maintained in their second or actuated condition during movement of the pushbutton 14 from its fully actuated position back to its initial position. If the operator should inadvertently tease or partially actuate the pushbutton 14 as it moves back toward its initial position, the holding coil 22 is effective to maintain the actuator rod 40 in an extended condition so that the switches are maintained in their second or actuated condition.

When the pushbutton 14 has returned to its initial position, the holding coil 22 remains energized to maintain the switches 16 actuated. When the pushbutton 14 is subsequently depressed, the control assembly 20 de-energizes the holding coil 22 as the pushbutton reaches its fully actuated position. Therefore, the holding coil is ineffective to maintain the actuator rod 40 in the extended position shown in FIG. 5 once the pushbutton 14 has moved to its fully actuated position. However, at this time, the pushbutton 14 is in its fully actuated position. Therefore, the force transmitted from the pushbutton plunger 38 through the rod 46, actuator rod 40, and force transmitting member 48 (FIG. 2) to the actuator assembly 18 is effective to hold the switches 16 in their second or actuated conditions.

Releasing the pushbutton 14 for movement from its fully actuated position with the holding coil 22 de-energized, results in the actuator rod 40 being retracted by the biasing spring 52 (FIG. 2). As the actuator rod 40 is retracted, the force transmitting member 48 (FIG. 3) in the actuator assembly 18 is also retracted. However, the switches 16 remain in their second or actuated condition until the pushbutton 14 moves to its initial position.

As the pushbutton 14 moves toward its initial position and the force transmitting member 48, actuator rod 40 and control rod 36 move upwardly (as viewed in FIGS. 2 and 3), the switches 16 remain in their second or actuated condition until the last increment of movement of the pushbutton 14 toward its initial position. The switches 16 snap back to their first or unactuated condition as the pushbutton 14 reaches its initial position. The control functions which were initiated by actuating the switches 16 are then terminated as the switches return to their unactuated condition. Of course, these control functions can be re-established by merely depressing the pushbutton 14.

Remote Switch

When the remote switch 32 (FIG. 6) is actuated from its normally closed condition to an open condition, a supply of power to a control circuit 56 is interrupted. Interrupting the supply of power to the control circuit 56 results in the holding coil 22 being maintained in a de-energized condition. Therefore, when the pushbutton 14 is released for movement from its fully actuated position back to its initial position, the holding coil 22 is ineffective to maintain the actuator assembly 18 in an actuated condition.

Under this condition, when the holding coil 22 is not energized with the remote switch 32 actuated, the switch assembly 14 functions as a momentary switch assembly. Thus, the switches 16 are operated from their first or unactuated condition to their second or actuated condition as long as force is manually maintained on the pushbutton 14. When this force is released, the switches 16 return to their first or unactuated condition.

When the pushbutton 14 is manually actuated with the remote switch 32 (FIG. 6) in the open condition, force is transmitted from the pushbutton plunger 38 through the rod 36 and actuator rod 40 to the force transmitting member 48. The force applied by the flat lower surface of the force transmitting member 48 against the switches 16 is effective to operate the switches from their first or unactuated condition to their second or actuated condition as the pushbutton 14 reaches its fully actuated position. The switches 16 remain in their second or actuated condition as long as the pushbutton 14 is manually held against the influence of the biasing springs 26 and 52.

When the pushbutton 14 is released and moves back toward its initial position under the influence of the biasing spring 26, the actuator rod 40 is retracted by the biasing spring 52. The force transmitting member 48 moves upwardly (as viewed in FIGS. 2 and 3) under the influence of force applied against the force transmitting member 48 by the switches 16. However, the switches 16 remain in their second or actuated condition until the pushbutton 14 reaches its initial position. During the last increment of movement of the pushbutton 14 to its initial position, the switches 16 operate from their second or actuated condition back to their first or unactuated condition with a snap action.

Due to the snap action of the switches 16 from their first or unactuated condition to their second or actuated condition as the pushbutton 14 moves to the fully actuated condition, teasing or partial actuation of the pushbutton 14 is ineffective to cause operation of the switches 16. Similarly, when the pushbutton 14 is moved from its fully actuated position back toward its initial position, teasing or partial actuation of the pushbutton is ineffective to cause the switches 16 to operate from their second or actuated condition back to their first or unactuated condition.

Control Assembly

The control assembly 20 controls energization and de-energization of the holding coil 22. Energization of the holding coil 22 occurs as the pushbutton 14 moves to its fully actuated position and the switches 16 are operated from their first or unactuated condition to their second or actuated condition. The energized holding coil 22 is effective to hold the actuator assembly 18 in an actuated condition to maintain the switches 16 in their second condition. De-energization of the holding coil 22 occurs when the pushbutton 14 is moved from its initial position to its fully actuated position with the holding coil energized and the switches 16 in their actuated condition. De-energization of the holding coil 22 releases the actuator assembly 18 so that it can return to an unactuated condition when the pushbutton 14 returns to its initial position. As the pushbutton 14 moves to its initial position, the switches 16 return to their first or unactuated condition.

Figure 7:
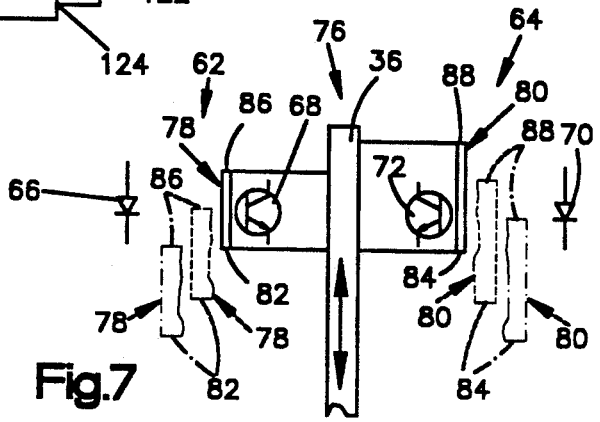
FIG. 7 is a highly schematicized illustration depicting the relationship between the shutters and the optical sensors during movement of the shutters relative to the optical sensors.

The control assembly 20 includes a pair of optical sensors, that is, a first optical sensor 62 and a second optical sensor 64 (FIGS. 3, 4, 6, and 7). The first optical sensor 62 includes a light source or light emitting diode 66 and a photocell or photosensitive transistor 68 (FIG. 6). The second optical sensor 64 includes a light source or light emitting diode 70 and a photocell or photosensitive transistor 72. A shutter assembly 76 (FIGS. 3 and 4) cooperates with the optical sensors 62 and 64 to control the transmission of light from the light sources 66 and 70 to the photocells 68 and 72 (FIGS. 6 and 7).

The shutter assembly 76 includes a first shutter 78 which controls the transmission of light in the first optical sensor 62 (FIG. 4) and a second shutter 80 which controls the transmission of light in the second optical sensor 64. It should be noted that the shutters 78 and 80 have lower (as viewed in FIG. 7) edge portions 82 and 84 which are horizontally aligned with each other. The shutters 78 and 80 have upper edge portions 86 and 88 which are vertically (as viewed in FIG. 7) offset relative to each other. Thus, as viewed in FIGS. 3, 4 and 7, the upper edge 88 of the shutter 80 is disposed above the upper edge 86 of the shutter 78. The two shutters 78 and 80 are fixedly connected to the control rod or carriage 36 for movement relative to the optical sensors 62 and 64. The light sources 66 and 70 (FIG. 7) in the optical sensors 62 and 64 are at the same level. The photocells 68 and 72 are also at the same level and are at the same level as the light sources 66 and 70.

The optical sensors 62 and 64 are mounted on a circuit board 92 (FIGS. 3 and 4) upon which the control circuit 56 (FIG. 6) is disposed. The circuit board 92 is fixedly secured to a guide block 94 (FIG. 3). A ribbon conductor 96 conducts electrical energy to the circuit board 92 and the block 42 in which the holding coil 22 is mounted. The control rod or shutter carriage 36 is vertically movable relative to the guide block 94.

The optical sensors 62 and 64 control the operation of a flip-flop 100 (FIG. 6) in the control circuit 56. The flip-flop 100 is a positive-edge-triggered D flip-flop. Of course, other known devices could be used if desired. An output pin or terminal 102 of the flip-flop 100 is connected with a field-effect transistor 104 which controls the energization of the holding coil 22. Thus, when the output terminal 102 of the flip-flop 100 is low, the transistor 104 is nonconducting and the coil 22 is de-energized. When the output terminal 102 of the flip-flop 100 is high, the transistor 104 is rendered conducting and the holding coil 22 is energized.

A relatively low voltage for the photocells 68 and 72 is provided over a lead 108. The remote switch 32 is normally closed and is connected in a power supply line 110 of a pair of power supply lines 110 and 112.

When the pushbutton 14 is in its initial position, the shutters 78 and 80 block the transmission of light from the light sources 66 and 70 to the photocells 68 and 72 in the manner shown in solid lines in FIG. 7. As the pushbutton 14 is depressed from the initial position to an intermediate position, the shutters 78 and 80 move downwardly from the initial position shown in solid lines in FIG. 7 to the intermediate position indicated schematically in dashed lines in FIG. 7. As the pushbutton 14 continues to be depressed, the shutters 78 and 80 move downwardly from the intermediate position to the fully actuated position indicated schematically in dash-dot lines in FIG. 7.

For purposes of clarity of illustration, the various positions of the shutters have been shown as being horizontally offset in FIG. 7. However, it should be understood that the shutters 78 and 80 move straight downwardly from the initial position shown in solid lines through the intermediate position shown in dashed lines to the fully actuated position shown in dash-dot lines in FIG. 7 as the pushbutton 14 is depressed. When the pushbutton 14 is manually depressed with a continuous motion, the shutters 78 and 80 move from the initial position through the intermediate position to the fully actuated position without stopping.

Since the upper edges 86 and 88 of the shutters are offset, the relatively low upper edge 86 of the shutter 78 will clear the space between the light source 66 and photocell 68 when the shutter 78 has moved to the intermediate position shown in dashed lines in FIG. 7. At this time, the shutter 80 is blocking the transmission of light from the source 70 to the photocell 72. Therefore, the photocell 68 is rendered transmitting before the photocell 72.

Continued downward (as viewed in FIG. 7) movement of the shutters 78 and 80 from the intermediate position to the end of stroke position shown in dash-dot lines, moves the upper edge 88 of the shutter 80 clear of the space between the light source 70 and photocell 72. Therefore, the photocell 72 is rendered conducting as the shutter 80 reaches the fully actuated position shown in dash-dot lines in FIG. 7. Of course, the photocell 68 is still conducting when the shutters 78 and 80 reach the fully actuated position.

When the shutter 78 moves from the initial position shown in solid lines shown in FIG. 7, to the intermediate position, shown in dashed lines in FIG. 7, the photocell 68 is rendered conducting and an input pin or terminal 116 (FIG. 6) on the flip-flop 100 changes from a low state to a high state. Similarly, when the shutter 80 moves from the initial position shown in solid lines through the intermediate position to the end of stroke position shown in dash-dot lines in FIG. 7, the photocell 72 is rendered conducting and an input pin or terminal 118 (FIG. 6) on the flip-flop 100 changes from a low state to a high state.

When the pushbutton 14 is in its initial position and the optical sensors 62 and 64 are rendered nonconducting by the shutter assembly 76, the output terminal 102 of the flip-flop 100 (FIG. 6) is low and the coil 22 is de-energized. As the pushbutton 14 is depressed, the shutter 78 moves to the intermediate position and the photocell 68 is rendered conducting to change the input terminal 116 of the flip-flop from low to high. As this occurs, the output terminal 102 of the flip-flop 100 remains low and the coil 22 remains de-energized.

When the shutters 78 and 80 reach their end of stroke positions, the photocell 72 is rendered conducting and the input terminal 118 to the flip-flop 100 changes from low to high. As this occurs, the output terminal 102 of the flip-flop 100 changes from low to high to render the transistor 104 conducting. This effects energization of the holding coil 22.

When the pushbutton 14 is released, the shutters 78 and 80 move back toward their initial positions, shown in solid lines in FIG. 7. As this occurs, the shutters 78 and 80 first block the transmission of light from the source 70 to the photocell 72 and then block the transmission of light from the source 66 to the photocell 68. Therefore, the terminal 118 goes low and then the terminal 116 goes low. However, the flip-flop 100 remains set and the output terminal 102 remains high so that the holding coil 22 is maintained in an energized condition.

To de-energize the holding coil 22, the pushbutton 14 is again depressed. This results in sequential movement of the shutters 78 and 80 from the initial position through the intermediate position to the end of stroke position. At the shutters 78 and 80 move to the intermediate position, the shutter 78 moves out of blocking relationship with the light source 66 and photocell 78 so that the input terminal 116 of the flip-flop 100 changes from low to high. However, the output terminal 102 of the flip-flop 100 remains high.

When the shutters 78 and 80 are moved to their fully actuated positions, the photocell 72 is rendered conducting so that the input terminal 118 of the flip-flop 100 changes from low to high. This causes the state of the flip-flop 100 to change and the output terminal 102 changes from high to low. This renders the transistor 104 nonconducting and de-energizes the holding coil 22. Although the holding coil 22 is de-energized, the pushbutton 14 and actuator assembly 18 (FIG. 3) maintain the switches 16 in their second or actuated condition.

As the pushbutton 14 is released, the shutters 78 and 80 move from their fully actuated positions through their intermediate positions to their initial positions. As this occurs, the transmission of light from the source 70 to the photocell 72 is blocked and then the transmission of light from the source 66 to the photocell 68 is blocked. This causes the flip-flop input terminal 118 and then the flip-flop input terminal 116 to change from high to low. This does not effect the state of the flip-flop 100 and the output terminal 102 remains low. Therefore, the coil 22 is maintained in a de-energized condition. Of course, subsequent actuation of the pushbutton 14 can result in the holding coil 22 again being energized in the manner previously explained.

Operation

Upon start up, power is conducted to the control circuit 56 through the power lines 110 and 112. A relatively low voltage is conducted through the line 108 to a start-up circuit 122. The start-up circuit 122 forces the flip-flop 100 to an initial condition in which the terminal 102 is low.

Upon start-up, the biasing spring 26 urges the pushbutton 14 to its initial position. In addition, the biasing spring 26 urges the shutters 78 and 80 to the initial position shown in solid lines in FIG. 7 so that the optical sensors 62 and 64 are blocked. Therefore, the holding coil 22 is de-energized and the actuator assembly 18 is in an unactuated condition. At this time, the switches 16 are in their first or unactuated condition.

Upon start-up, the control circuit 56 is in state 0, as shown in the following table. When the control circuit 56 is in state 0, the input pins or terminals 116, 118 of the flip-flop 100 are low. At this time, a terminal or pin 122 (FIG. 6) of the flip-flop 100 is high and a terminal or pin 124 of the flip-flop is low. The flip-flop output pin or terminal 102 is also low at start-up.

| State of Circuit | Flip-Flop Terminals Pin 116 | Pin 118 | Pin 122 | Pin 124 | Pin 102 | Push-button Position |
|---|---|---|---|---|---|---|
| 0 | 0 | 0 | 1 | 0 | 0 | Initial-start-up |
| 1 | 1 | 0 | 1 | 1 | 0 | Intermediate |
| 2 | 1 | 1 | 0 | 1 | 1 | Fully actuated |

-continued

| State of Circuit | Flip-Flop Terminals Pin 116 | Pin 118 | Pin 122 | Pin 124 | Pin 102 | Push-button Position |
|---|---|---|---|---|---|---|
| 3 | 1 | 0 | 0 | 1 | 1 | Intermediate |
| 4 | 0 | 0 | 0 | 1 | 1 | Initial |
| 5 | 1 | 0 | 0 | 0 | 1 | Intermediate |
| 6 | 1 | 1 | 1 | 0 | 0 | Fully actuated |
| 7 | 1 | 0 | 1 | 0 | 0 | Intermediate |
| 8 | 0 | 0 | 1 | 0 | 0 | Initial |

When the pushbutton 14 is depressed, the condition of the control circuit 56 remains at state 0 until the shutters 78 and 80 have moved to the intermediate position shown in dashed lines in FIG. 7. When the shutter 78 reaches the intermediate position, the control circuit 56 changes to state 1. When the control circuit 56 is in state 1, the optical sensor 62 has been rendered conducting by movement of the upper edge 86 of the shutter 78 out of the path of transmission of light from the source 66 to the photocell 68. This results in the flip-flop input terminal or pin 116 going high. At the same time, flip-flop pin or terminal 124 goes high. However, the output pin or terminal 102 of the flip-flop 100 remains low.

As the operating stroke of the pushbutton 14 continues and the pushbutton reaches the fully actuated position, the condition of the control circuit 56 changes to state 2. When the pushbutton 14 is in the fully actuated position, the upper edge 88 of the shutter 80 has cleared the optical sensor 64 and input pin 118 is high. This causes pin 122 to go low while pin 124 remains high. The state of the flip-flop 100 changes and the output pin 102 goes high.

When the output pin 102 of the flip-flop 100 goes high, the transistor 104 is rendered conducting and the holding coil 22 is energized. This results in the actuator rod 40 being held in the extended position shown in FIG. 5 by the holding coil 22. As the actuator rod 40 is moved to the extended position by movement of the pushbutton 14 to its fully actuated position, the actuator assembly 18 actuates the switches 16. The holding coil 22 maintains the actuator rod 40 extended so that the switches 16 remain actuated when the pushbutton 14 is released.

Upon releasing of the pushbutton 14, the biasing spring 26 moves the pushbutton toward its initial position. When the pushbutton 14 reaches its intermediate position, the state of the control circuit 56 changes to state 3. In state 3, the shutter 80 blocks the optical sensor 62 and the input terminal 118 of the flip-flop 100 goes low. The condition of the other terminals of the flip-flop 100 remain the same as in state 2.

As the pushbutton 14 reaches its initial position, the condition of the control circuit 56 changes to state 4. At this time, the shutter 78 is blocking the optical sensor 62 and the input pin 116 goes low. The state of the other terminals of the flip-flop 100 do not change. Therefore, the holding coil 22 remains in an energized condition while the pushbutton 14 is in its initial position. This results in the switches 16 being held in an actuated condition by the actuator assembly 18.

Assuming that the remote switch 32 is not actuated, the condition of the control circuit 56 remains constant at state 4 until the pushbutton 14 is again depressed. When the pushbutton 14 is manually depressed for a second time, the pushbutton moves to its intermediate position and the condition of the circuit 56 changes to state 5. As the pushbutton 14 moves to the intermediate position, flip-flop input terminal or pin 116 changes from low to high as the upper edge 86 of the shutter 78 moves downwardly to enable light to be transmitted from the source 66 to the photocell 68. However, at this time, the optical sensor 64 is blocked by the shutter 80 and the pin or terminal 118 remains low. The terminal 124 goes low. The output terminal 102 remains high so that the holding coil 22 continues to be energized.

As the pushbutton 14 moves to its fully actuated position, the condition of the control circuit 56 changes from state 5 to state 6. At this time, the upper edge 88 of the shutter 80 has moved downwardly through a distance sufficient to enable the optical sensor 64 to conduct to the terminal 118 of the flip-flop 100. This results in the terminals 118 and 122 of the flip-flop 100 going high. The flip-flop output terminal 102 goes low. Therefore, the transistor 104 is rendered nonconducting and holding coil 22 is de-energized. Even though the holding coil 22 is de-energized, the actuator assembly 18 continues to maintain the switches 16 in an actuated condition until the pushbutton 14 is released and has moved back to its initial position.

Upon releasing of the pushbutton 14 and movement of the pushbutton to its intermediate position, the condition of the control circuit 56 changes from state 6 to state 7. At this time, the shutter 80 again blocks the optical sensor 64 and the terminal 118 of the flip-flop 100 goes low. The output terminal 102 of the flip-flop remains low so that the holding coil 22 is maintained de-energized.

As the pushbutton 14 reaches its initial position, the condition of the control circuit 56 changes from state 7 to state 8. At this time, the shutter 78 again blocks the optical sensor 62 and the input terminal 116 of the flip-flop 100 goes low. At the same time, the actuator assembly 18 releases the switches 16 for movement from their actuated condition back to their unactuated condition. The condition of the control circuit 56 now corresponds to state 0, that is the initial or start-up condition.

When the control circuit 56 is in state 8, the pushbutton 14 must be moved all of the way to its fully actuated position before the switches 16 are actuated. Thus, if an operator partially actuates and releases the pushbutton 14, the actuator assembly 18 is not effective to actuate the switches 16 from their first or unactuated condition and the holding coil 18 is not energized. The reason that the switches 16 are not actuated by partial actuation of the pushbutton 14 is that the switches snap from the unactuated condition to the actuated condition only when the pushbutton 14 has been moved to its fully actuated position. The reason the holding coil 22 remains de-energized is that the shutter 80 does not clear the optical sensor 64 until the pushbutton 14 is moved to its fully actuated position. Therefore, partial actuation or teasing of the switch assembly 10 does not have any effect on control circuitry with which the switch assembly is connected.

Similarly, when the switch assembly is being released from the fully actuated position and the control circuit 56 is in state 2, partial movement of the pushbutton 14 away from its fully actuated position and then moving the pushbutton back to the fully actuated position (teasing) is ineffective to result in either de-energization of the holding coil 22 or operation of the switches 16 back to their unactuated condition. This because the holding coil 22 remains energized until the pushbutton 14 is moved all of the way back to its initial position and then is moved to its fully actuated position for a second time.

When the switch assembly 10 has been actuated to operate the switches 16 to their actuated condition and the control circuit 56 is in state 4, the remote switch 32 can be actuated to interrupt power to the control circuit 56. This results in the holding coil 22 being de-energized and the actuator assembly 18 released for movement to its unactuated condition. This results in the switches 16 being operated from their actuated condition back to their unactuated condition. Once this has been done, depressing of the pushbutton 14 to its fully actuated position will effect operation of the switches 16 to their actuated condition until the pushbutton is released and moves back to its initial position. The holding coil 22 can not be re-energized to maintain the switches 16 in their actuated condition until after the remote switch 32 has been closed.

Conclusion

An improved switch assembly 10 includes switches 16 which are at least partially disposed in a switch housing 12 and are operable between first and second conditions by an actuator assembly 18. A manually actuatable member (pushbutton) 14 is movable relative to the switch housing 10 to effect operation of the actuator assembly 18 between unactuated and actuated conditions. A holding coil 22 is energizeable to maintain the actuator assembly 18 and the switches 16 in their actuated conditions. A control assembly 20 is effective to control energization of the holding coil 22 in response to movement of the manually actuatable member 14.

A remote switch 32 may advantageously be connected with the control assembly. The remote switch 32 is actuatable to effect de-energization of the holding coil 22 and operation of the actuator assembly 18 to an unactuated condition. In addition, operating the remote switch 32 is effective to prevent subsequent energization of the holding coil 22.

The switch assembly 10 does not respond to teasing, i.e., partial actuation. Thus, the control assembly 20 is ineffective to either energize or de-energize the holding coil 22 in response to movement of the manually actuatable member 14 through less than a full operating stroke.

In one embodiment of the invention, the control assembly 20 includes optical sensors 62 and 64 which cooperate with shutters 78 and 80 to control the output from the control assembly 20. The shutters 78 and 80 move with the manually actuatable member 14 and are effective to cause a change in the condition of the optical sensors 62 and 64 upon movement of the manually actuatable member. The shutters 78 and 80 change the condition of the optical sensors 62 and 64 in a manner which effects energization or de-energization of the holding coil 22 only in response to movement of the manually actuatable member 14 through a complete operating stroke Having described the invention, the following is claimed:

1. A switch assembly comprising a switch housing, switch contacts at least partially disposed in said switch housing and operable between a first condition and a second condition, actuator means disposed in said switch housing and actuatable between an unactuated condition in which said switch contacts are in the first condition and an actuated condition in which said switch contacts are in the second condition, manually actuatable means at least partially disposed in said switch housing and movable relative to said switch housing for effecting actuation of said actuator means between the unactuated and actuated conditions, electromagnetic means disposed in said switch housing, said electromagnetic means having an energized condition and a de-energized condition, said actuator means being maintained in the actuated condition by said electromagnetic means when said electromagnetic means is in the energized condition, and control means disposed in said switch housing for energizing said electromagnetic means upon actuation of said actuator means to the actuated condition by movement of said manually actuatable means and for de-energizing said electromagnetic means upon actuation of a remote switch connected with said control means when said electromagnetic means is energized, said control means including means for de-energizing said electromagnetic means upon actuation of said actuator means to the actuated condition by movement of said manually actuatable means with said electromagnetic means energized, said control means including means for providing light, photocell means responsive to light from said means for providing light, and shutter means which is movable between a blocking condition blocking the transmission of light from said means for providing light to said photocell means and a nonblocking condition enabling light to be transmitted from said means for providing light to said photocells, means, said manually actuatable means including means for moving said shutter means upon movement of said manually actuatable means.

2. A switch assembly as set forth in claim 1 wherein said control means includes means for changing said electromagnetic means from the de-energized condition to the energized condition in response to movement of said shutter means from a first one of said blocking and nonblocking conditions to a second one of said blocking and nonblocking conditions and for changing said electromagnetic means from the energized condition to the de-energized condition in response to movement of said shutter means from the first one of said blocking and nonblocking conditions to the second one of said blocking and nonblocking conditions.

3. A switch assembly as set forth in claim 1 wherein said shutter means includes a plurality of shutters, said means for moving said shutter means upon actuation of said manually actuatable means includes means for moving a first one of said plurality of shutters from a first one of its blocking and nonblocking conditions to a second one of its blocking and nonblocking conditions upon partial actuation of said manually actuatable means and for moving a second one of said plurality of shutters from a first one of its blocking and nonblocking conditions to a second one of its blocking and nonblocking conditions while maintaining said first one of said shutters in said second one of its blocking and nonblocking conditions upon continued actuation of said manually actuatable means to a fully actuated condition.

4. A switch assembly as set forth in claim 1 wherein said control means includes means for maintaining said electromagnetic means in a de-energized condition upon actuation of said actuator means to the actuated condition by movement of said manually actuatable means when the remote switch is actuated and said electromagnetic means is de-energized.

5. A switch assembly comprising a switch housing, switch contacts at least partially disposed in said switch housing and operable between a first condition and a second condition, actuator means disposed in said switch housing and actuatable between an unactuated condition in which said switch contacts are in the first condition and an actuated condition in which said switch contacts are in the second condition, manually actuatable means at least partially disposed in said switch housing and movable relative to said switch housing for effecting actuation of said actuator means between the unactuated and actuated conditions, electromagnetic means disposed in said switch housing, said electromagnetic means having an energized condition and a de-energized condition, said actuator means being maintained in the actuated condition by said electromagnetic means when said electromagnetic means is in the energized condition, and control means disposed in said switch housing for energizing said electromagnetic means upon actuation of said actuator means to the actuated condition by movement of said manually actuatable means and for de-energizing said electromagnetic means upon actuation of a remote switch connected with said control means when said electromagnetic means is energized, said control means including circuit means having an output signal which effects energization of said electromagnetic means and is established in response to movement of said manually actuatable means from an initial position through an intermediate position to a fully actuated position, said circuit means being ineffective to provide the output signal which effects energization of said electromagnetic means in response to movement of said manually actuatable means from the initial position to a position other than the fully actuated position, said circuit means being operable to eliminate the output signal and de-energize said electromagnetic means in response to movement of said manually actuatable means from the initial position through the intermediate position to the fully actuated position with said electromagnetic means energized, said circuit means being ineffective to eliminate the output signal and de-energize said electromagnetic means in response to movement of said manually actuatable means until said manually actuatable means has been moved from the fully actuated position to the initial position after establishment of the output signal by movement of said manually actuatable means to the fully actuated position and until said manually actuatable means has been moved from the initial position back to the fully actuated position.

6. A switch assembly as set forth in claim 5 wherein said circuit means includes a first sensor having a conducting condition and a nonconducting condition, a second sensor having a conducting condition and a nonconducting condition, and first and second elements movable in said switch housing by said manually actuatable means to change the condition of said first and second sensors during movement of said manually actuatable means between the initial and fully actuated positions, said first and second elements being effective to change the condition of said first sensor from a first one of said conducting and nonconducting conditions to a second one of said conducting and nonconducting conditions upon movement of said manually actuatable means from the initial position to the intermediate position and being effective to maintain the condition of said second sensor constant during movement of said manually actuatable means from the initial position to the intermediate position, said first and second elements being effective to change the condition of said second sensor from a first one of said conducting and nonconducting conditions to a second one of said conducting and nonconducting conditions upon movement of said manually actuatable means from the intermediate position to the fully actuated position and being effective to maintain the condition of said first sensor constant during movement of said manually actuatable means from the intermediate position to the fully actuated position, said first and second elements being effective to change the condition of said second sensor from the second one of said conducting and nonconducting conditions to the first one of said conducting and nonconducting conditions upon movement of said manually actuatable means from the fully actuated position to the intermediate position and being effective to maintain the condition of said first sensor constant during movement of said manually actuatable means from the fully actuated position to the intermediate position, said first and second elements being effective to change the condition of said first sensor from the second one of said conducting and nonconducting conditions to the first one of said conducting and nonconducting conditions upon movement of said manually actuatable means from the intermediate position to the initial position and being effective to maintain the condition of said second sensor constant during movement of said manually actuatable means from the intermediate position to the initial position.

7. A switch assembly as set forth in claim 6 wherein said first and second sensors are both in the nonconducting condition when said first and second sensors are in the first condition and said first and second sensors are both in the conducting condition when said first and second sensors are in the second condition.

8. A switch assembly as set forth in claim 6 wherein said first and second sensors are optical sensors and said first and second elements are shutters.

9. A switch assembly comprising a switch housing, switch contacts at least partially disposed in said switch housing and operable between a first condition and a second condition, actuator means disposed in said switch housing and actuatable between an unactuated condition in which said switch contacts are in the first condition and an actuated condition in which said switch contacts are in the second condition, manually actuatable means at least partially disposed in said switch housing and movable relative to said switch housing for effecting actuation of said actuator means between the unactuated and actuated conditions, electromagnetic means disposed in said switch housing, said electromagnetic means having an energized condition and a de-energized condition, said actuator means being maintained in the actuated condition by said electromagnetic means when said electromagnetic means is in the energized condition and control means disposed in said switch housing for energizing and de-energizing said electromagnetic means, said control means including a plurality of light sources disposed in said switch housing, a plurality of photocells disposed in said switch housing, a plurality of shutters which are movable between a blocking condition blocking the transmission of light from said light sources to said photocells and a nonblocking condition enabling light to be transmitted from said light sources to said photocells to change the output of said photocells, said manually actuatable means including means for moving said plurality of shutters upon movement of said manually actuatable means, and circuit means connected with said photocells for energizing said electromagnetic means in response to a change in the output of said photocells upon movement of said manually actuatable means relative to said switch housing from an initial position to an actuated position with said electromagnetic means de-energized and for de-energizing said electromagnetic means in response to a change in the output of said photocells upon movement of said manually actuatable means relative to said switch housing from the initial position to the actuated position with said electromagnetic means energized.

10. A switch assembly as set forth in claim 9 wherein said actuator means includes an actuator member which is at least partially enclosed by said electromagnetic means, said plurality of shutters are mounted on a carrier which is movable relative to said electromagnetic means, said manually actuatable means being movable from the initial position to the actuated position with said electromagnetic means de-energized to move said carrier and said plurality of shutters relative to said plurality of light sources and said plurality of photocells to change the output of said plurality of photocells and to effect movement of said actuator member relative to said electromagnetic means from a first -position to a second position, said electromagnetic means being effective to maintain said actuator member in the second position upon movement of said manually actuatable means relative to said switch housing from the actuated position to the initial position with said electromagnetic means energized, said manually actuatable means being movable from the initial position to the actuated position with said electromagnetic means energized to move said carrier and said plurality of shutters relative to said plurality of light sources and said plurality of photocells to change the output of said plurality of photocells with said actuator member in the second position.

11. A switch assembly as set forth in claim 10 further including means for moving said actuator member from the second position to the first position and for moving said carrier and plurality of shutters relative to said plurality of light sources and said plurality of photocells to change the output of said plurality of photocells upon movement of said manually actuatable means from the actuated position to the initial position with said electromagnetic means de-energized.

12. A switch assembly as set forth in claim 11 wherein one end portion of said carrier is engageable with said actuator member to move said actuator member from the first position to the second position upon movement of said manually actuatable means from the initial position to the actuated position with said electromagnetic means de-energized.

13. A switch assembly as set forth in claim 10 further including a member disposed in said switch housing and having surface means for guiding movement of said carrier relative to said member, said circuit means including a printed circuit board mounted on said member, said light sources and photocells being mounted on said circuit board.

14. A switch assembly as set forth in claim 9 wherein said plurality of shutters are mounted on a carrier which is moved in a first direction along a path during movement of said manually actuatable means relative to said switch housing from the initial position to the actuated position and is moved in a second direction along the path during movement of said manually actuatable means from the actuated position to the initial position, said shutters having first edge portions which are leading during movement of said carrier in one of said directions along the path, said first edge portion of one of said shutters being ahead of said first edge portion of another of said shutters during movement of said carrier along said path in said one direction.

15. A switch assembly as set forth in claim 9 wherein said circuit means includes means for de-energizing said electromagnetic means upon actuation of a remote switch connected with said circuit means.

16. A switch assembly as set forth in claim 9 wherein movement of said manually actuatable means relative to said switch housing from the initial position to an intermediate position disposed between said initial and actuated positions moves a first one of said shutters from a first one of its blocking and nonblocking conditions to a second one of its blocking and nonblocking conditions while maintaining a second one of said shutters in a first one of its blocking and nonblocking conditions, movement of said manually actuatable means from said intermediate position to said actuated position moves said second one of said shutters from the first one of its blocking and nonblocking conditions to a second one of its blocking and nonblocking conditions while maintaining said first one of said shutters in the second one of its blocking and nonblocking conditions 17. A switch assembly as set forth in claim 16 wherein movement of said manually actuatable means relative to said switch housing from the actuated position to the intermediate position moves said second one of said shutters from the second one of its blocking and nonblocking conditions to the first one of its blocking and nonblocking conditions while maintaining said first one of said shutters in the second one of its blocking and nonblocking conditions, movement of said manually actuatable means from said intermediate position to said initial position moves said first one of said shutters from the second one of its blocking and nonblocking conditions to the first one of its blocking and nonblocking conditions while maintaining said second one of said shutters in the first one of its blocking and nonblocking conditions.

18. An apparatus as set forth in claim 17 wherein said control means includes means for de-energizing said electromagnetic means upon actuation of a remote switch connected with said control means and for maintaining said electromagnetic means in a de-energized condition upon actuation of said actuator means to the actuated condition by movement of said manually actuatable means when said remote switch is actuated and said electromagnetic means is de-energized.

19. A switch assembly comprising a switch housing, switch contacts at least partially disposed in said switch housing and operable between a first condition and a second condition, actuator means disposed in said switch housing and actuatable between an unactuated condition in which said switch contacts are in the first condition and an actuated condition in which said switch contacts are in the second condition, manually actuatable means at least partially disposed in said switch housing and movable relative to said switch housing for effecting actuation of said actuator means between the unactuated and actuated conditions, electromagnetic means disposed in said switch housing, said electromagnetic means having an energized condition and a de-energized condition, said actuator means being maintained in the actuated condition by said electromagnetic means when said electromagnetic means is in the energized condition, and control means disposed in said switch housing for energizing said electromagnetic means upon actuation of said actuator means to the actuated condition by movement of said manually actuatable means when said electromagnetic means is de-energized, said control means including means for de-energizing said electromagnetic means upon actuation of said manually actuatable means when said electromagnetic means is energized, said control means includes circuit means having an output signal which effects energization of said electromagnetic means and which is established in response to movement of said manually actuatable means from an initial position through an intermediate position to a fully actuated position, said circuit means being ineffective to provide the output signal which effects energization of said electromagnetic means in response to movement of said manually actuatable means from the initial position to a position other than the fully actuated position, said circuit means being operable to eliminate the output signal and de-energize said electromagnetic means in response to movement of said manually actuatable means from the initial position through the intermediate position to the fully actuated position with said electromagnetic means energized, said circuit means being ineffective to eliminate the output signal and de-energize said electromagnetic means in response to movement of said manually actuatable mean until said manually actuatable means has been moved from the fully actuated position to the initial position after establishment of the output signal by movement of said manually actuatable means to the fully actuated position and until said manually actuatable means has been moved from the initial position back to the fully actuated position with said electromagnetic means energized.

20. A switch assembly as set forth in claim 19 wherein said circuit means includes a first sensor having a conducting condition and a nonconducting condition, a second sensor having a conducting condition and a nonconducting condition, and first and second elements movable in said switch housing by said manually actuatable means to change the condition of said first and second sensors during movement of said manually actuatable means between the initial and fully actuated positions, said first and second elements being effective to change the condition of said first sensor from a first one of said conducting and nonconducting conditions to a second one of said conducting and nonconducting conditions upon movement of said manually actuatable means from the initial position to the intermediate position and being effective to maintain the condition of said second sensor constant during movement of said manually actuatable means from the initial position to the intermediate position, said first and second elements being effective to change the condition of said second sensor from a first one of said conducting and nonconducting conditions to a second one of said conducting and nonconducting conditions upon movement of said manually actuatable means from the intermediate position to the fully actuated position and being effective to maintain the condition of said first sensor constant during movement of said manually actuatable means from the intermediate position to the fully actuated position, said first and second elements being effective to change the condition of said second sensor from the second one of said conducting and nonconducting conditions to the first one of said conducting and nonconducting conditions upon movement of said manually actuatable means from the fully actuated position to the intermediate position and being effective to maintain the condition of said first sensor constant during movement of said manually actuatable means from the fully actuated position to the intermediate position, said first and second elements being effective to change the condition of said first sensor from the second one of said conducting and nonconducting conditions to the first one of said conducting and nonconducting conditions upon movement of said manually actuatable means from the intermediate position to the initial position and being effective to maintain the condition of said second sensor constant during movement of said manually actuatable means from the intermediate position to the initial position.

21. A switch assembly as set forth in claim 20 wherein said first and second sensors are both in the nonconducting condition when said first and second sensors are in the first condition and said first and second sensors are both in the conducting condition when said first and second sensors are in the second condition.

22. A switch assembly as set forth in claim 20 wherein said first and second sensors are optical sensors and said first and second elements are shutters.

23. A switch assembly as set forth in claim 20 wherein said circuit means includes means for de-energizing said electromagnetic means upon actuation of a remote switch connected with said circuit means.

24. A switch assembly as set forth in claim 19 wherein said circuit means includes a plurality of light sources disposed in said switch housing, a plurality of photocells disposed in said housing, and a plurality of shutters each of which is movable between a blocking condition blocking the transmission of light from one of said light sources to one of said photocells and a nonblocking condition enabling light to be transmitted from said one of said light sources to said one of said photocells, said manually actuatable means including means for moving said plurality of shutters upon movement of said manually actuatable means.

25. A switch assembly as set forth in claim 24 wherein said means for moving said plurality of shutters upon actuation of said manually actuatable means includes means for moving a first one of said shutters from a first one of its blocking and nonblocking conditions to a second one of its blocking and nonblocking conditions upon actuation of said manually actuatable means and for moving a second one of said shutters from a first one of its blocking and nonblocking conditions to a second one of its blocking and nonblocking conditions while maintaining said first one of said shutters in said second one of its blocking and nonblocking conditions.

26. An apparatus as set forth in claim 19 wherein said control means includes means for de-energizing said electromagnetic means upon actuation of a remote switch connected with said control means and for maintaining said electromagnetic means in a de-energized condition upon actuation of said actuator means to the actuated condition by movement of said manually actuatable means when said remote switch is actuated and said electromagnetic means is de-energized.

27. A switch assembly comprising a switch housing, switch contacts at least partially disposed in said switch housing and operable between a first condition and a second condition, actuator means disposed in said switch housing and actuatable between an unactuated condition in which said switch contacts are in the first condition and an actuated condition in which said switch contacts are in the second condition, means at least partially disposed in said switch housing and movable relative to said switch housing for effecting actuation of said actuator means between the unactuated and actuated conditions, electromagnetic means disposed in said switch housing, said electromagnetic means having an energized condition and a de-energized condition, said actuator means being maintained in the actuated condition by said electromagnetic means when said electromagnetic means is in the energized condition, and control means disposed in said switch housing for energizing said electromagnetic means upon actuation of said actuator means to the actuated condition and for de-energizing said electromagnetic means upon actuation of said actuator means to the actuated condition with said electromagnetic means energized, said control means including means for providing light, photocell means responsive to light from said means for providing light, and shutter means which is movable between a blocking condition blocking the transmission of light from said means for providing light to said photocell means and a nonblocking condition enabling light to be transmitted from said means for providing light to said photocells means.

28. A switch assembly as set forth in claim 27 wherein said control means includes means for changing said electromagnetic means from the de-energized condition to the energized condition in response to movement of said shutter means from a first one of said blocking and nonblocking conditions to a second one of said blocking and nonblocking conditions and for changing said electromagnetic means from the energized condition to the de-energized condition in response to movement of said shutter means from the first one of said blocking and nonblocking conditions to the second one of said blocking and nonblocking conditions.

29. A switch assembly as set forth in claim 27 wherein said shutter means includes a plurality of shutters, said means for moving said shutter means includes means for moving a first one of said plurality of shutters from a first one of its blocking and nonblocking conditions to a second one of its blocking and nonblocking conditions upon partial operation of said switch assembly and for moving a second one of said plurality of shutters from a first one of its blocking and nonblocking conditions to a second one of its blocking and nonblocking conditions while maintaining said first one of said shutters in said second one of its blocking and nonblocking conditions upon continued operation of said switch assembly to a fully operated condition.

30. A switch assembly as set forth in claim 27 wherein said control means includes circuit means having an output signal which effects energization of said electromagnetic means and is established in response to operation of said switch assembly from an initial condition through an intermediate condition to a fully operated condition and movement of said shutter means from a first one of said blocking and nonblocking conditions to a second one of said blocking and nonblocking conditions, said circuit means being ineffective to provide the output signal which effects energization of said electromagnetic means in response to operation of said switch assembly from the initial condition to a condition other than the fully operated condition and movement of said shutter means from the first one of said blocking and nonblocking conditions to a condition intermediate the first and second blocking and nonblocking conditions, said circuit means being operable to eliminate the output signal and de-energize said electromagnetic means in response to operation of said switch assembly from the initial condition through the intermediate condition to the fully operated condition with said electromagnetic means energized, and to movement of said shutter means from the first one of said blocking and nonblocking conditions to the second of said blocking and nonblocking conditions, said circuit means being ineffective to eliminate the output signal and de-energize said electromagnetic means in response to operation of said switch assembly until said switch assembly has been operated from the fully operated condition to the initial condition after establishment of the output signal by operation of said switch assembly to the fully operated condition and until said switch assembly has been moved from the initial condition back to the fully operated condition and said shutter means has moved from the second one of said blocking and nonblocking conditions back to the first one of said blocking and nonblocking conditions.

* * * * *

UNITED STATES PATENT AND TRADEMARK OFFICE

CERTIFICATE OF CORRECTION

PATENT NO. : 5,294,900

DATED : March 15, 1994

INVENTOR(S) : Akbar Mohabbatizādeh and Ali Malezadeh

It is certified that error appears in the above-identified patent and that said Letters Patent is hereby corrected as shown below:

Column 18, line 24, change "mean" to --means--.

Signed and Sealed this

Ninth Day of August, 1994

*Attest:*

*Attesting Officer*

BRUCE LEHMAN

*Commissioner of Patents and Trademarks*